United States Patent [19]

Prest

[11] Patent Number: 4,722,145

[45] Date of Patent: Feb. 2, 1988

[54] REUSABLE MARKING SYSTEM

[76] Inventor: Jeffrey C. Prest, 2880 Illiana Ct., Orlando, Fla. 32806

[21] Appl. No.: 708,810

[22] Filed: Mar. 6, 1985

[51] Int. Cl.[4] ..... G09F 7/00

[52] U.S. Cl. ..... 40/584; 434/408; 106/23; 106/32.5

[58] Field of Search ..... 434/408, 416; 40/584, 40/10 C; 106/32.5, 23

[56] References Cited

U.S. PATENT DOCUMENTS

| | | | |
|---|---|---|---|
| 1,970,697 | 8/1934 | Hammitt | 40/10 C |
| 3,069,790 | 12/1962 | Oswald | 434/413 |
| 4,267,088 | 5/1981 | Kempf | 106/23 |
| 4,449,310 | 5/1984 | Kline | 40/11 R |

FOREIGN PATENT DOCUMENTS

| | | | |
|---|---|---|---|
| 7600804 | 7/1976 | Netherlands | 434/408 |
| 2143986 | 2/1985 | United Kingdom | 40/607 |

OTHER PUBLICATIONS

"The Sporting Goods Dealer", Mar. 1979, p. 193.
"Playthings", Feb. 10, 1960, p. 195.
"Dupont Magazine", vol. 65, No. 3, May/Jun. 1971, pp. 7–9.

*Primary Examiner*—Gene Mancene
*Assistant Examiner*—Cary E. Stone
*Attorney, Agent, or Firm*—Duckworth, Allen & Dyer

[57] ABSTRACT

A reusable marking system comprising a high impact styrene plastic marking surface and a specially formulated water soluble marking ink. The ink is carried in a felt tip marker and can be removed from the marking surface using a damp wiper. The marking surface can be permanently marked using screen printing techniques to provide suitable permanent messages or to delineate areas for non-permanent markings.

20 Claims, 2 Drawing Figures

REUSABLE MARKING SYSTEM

BACKGROUND OF THE INVENTION

The present invention relates to marking systems and, more particularly, to reusable marking systems including an erasable marking surface and marking device.

Prior art reusable marking systems include slate and synthetic materials which are marked upon by chalk and porcelanized or melamine boards which are specially treated to be marked upon by a liquid ink marker. Both of these systems are erasable using either a dry or wet wiper. Furthermore, both of these systems represent a significant cost investment. Because of the cost investment in these reusable prior art systems, their utilization has been limited to classrooms and selected business applications even though there are high-volume areas in which re-usable marking surfaces would be advantageous. For example, for in-store advertising in grocery supermarkets and drugstores, preprinted paper based posters are used in which pricing or other information is written using various types of marking devices, such as felt tip markers. Once the information inserted by the felt tip marker becomes out dated, the posters must then be discarded. Nevertheless, the cost of the prior art reusable systems has continued to make disposable posters economical.

Accordingly, it is an object of the present invention to provide an improved reusable marking system.

It is another object of the present invention to provide a reusable marking system which is not erasable by inadvertent dry contact.

It is a still further object to provide an improved marking system which can be economically produced.

The above and other objects are achieved in a marking system comprising a marking surface formed from a high impact styrene plastic and a marking device using a water soluble ink. The marking surface may either be matte or calendered and is formed from commercially available styrene plastic sheet material. The water soluble ink is specially treated to adhere to the plastic surface. In a preferred embodiment, the sheet material is cut into various shaped signs which are self-supporting and permanently printed with advertising messages leaving areas for insertion of non-permanent messages using the marking devices. Tabs are formed as an integral part of each sign to provide a support. For larger applications such as bulletin boards, other support apparatus may be provided for the sheet material.

DESCRIPTION OF THE DRAWINGS

The above and other objects and features of the invention will become apparent by reference to the following detailed description taken in conjunction with the accompanying drawing in which.

DETAILED DESCRIPTION

Figure 1:
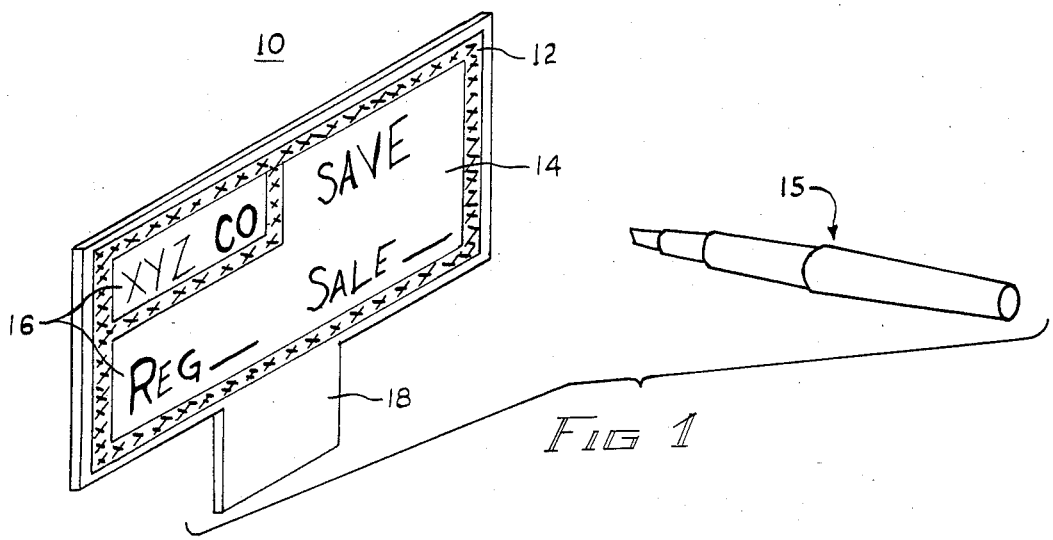
FIG. 1 is a perspective view of a sign constructed in accordance with the present invention.

Referring now to FIG. 1 there is shown one embodiment of the present invention as applied to an in-store advertising sign 10. The sign 10 is preferably die-cut from a sheet of high impact styrene plastic (HIS plastic) of a type well known in the art. The plastic can be obtained in various thicknesses but for the illustrative application a preferred thickness is between 0.015 and 0.030 inches inclusive. The permanent marking on the sign is preferrably screen printed to provide a border 12 defining a marking area 14. Lettering 16 may be included for any desired advertising message.

Non-permanent messages may be written in the area 14 using a marking device 15 in the form of a felt tip marker of a type well known in the art. However, ink to be used with such a marking device, in addition to being water soluble to allow removal, must also contain a carrier or wetting agent to permit the ink dye to adhere to the plastic surface. Water base ink without a carrier will simply bead up and not adhere to the surface. Accordingly, a special ink has been developed which is formulated from commercially available water based ink dye and 0.5 per cent by volume of methyl alcohol. Less alcohol significantly increases drying time to the point, at about 0.2 percent, wherein the ink will no longer adhere to the surface. Above 0.5 percent by volume, the alcohol begins to dilute the ink so that opacity becomes less. The alcohol performs a dual function of preventing the water from beading on the plastic surface and also accelerates the evaporation of the liquid portion of the ink. Since the ink dye adheres to the plastic surface, it is not removable by wiping with a dry wiper thus providing a semipermanent record. However, since it is water soluble, the ink dye may be easily removed by wiping with a damp wiper thus allowing the sign to be re-used. Methanol alcohol and ethyl alcohol may also be used as suitable wetting agents.

A tab 18 is formed as an integral part of the sign 10 and can be used to support the sign by insertion into a suitable receptacle. Of course, the tab 18 may be omitted in those instances where the receptacle is designed to receive an edge of the sign 10.

Figure 2:
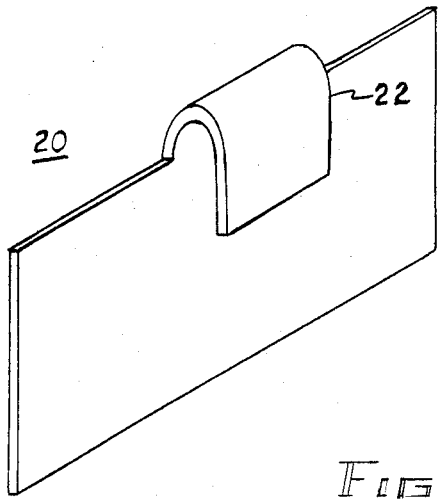
FIG. 2 is a perspective view of a further sign showing integral folded tabs for support.

Referring now to FIG. 2, there is shown a view of a reverse side of a sign 20 illustrating the use of a tab 22 bent parallel to a plane of the sign 20 for the purpose of allowing the sign 20 to be hung from the tab 22.

Although the present invention has been described in terms of an advertising sign system, it will be appreciated that larger marking systems, such as bulletin boards or classroom boards, could easily be constructed by using an appropriate frame support for the plastic sheet material. Accordingly, the appended claims are intended to cover and embrace any modifications falling within the true spirit and scope of the invention.

What is claimed is:

1. A reuseable advertising system comprising:

a self-supporting sign material; and a marking device, said sign material being formed of a high impact styrene plastic having permanent identifying legends printed on a surface thereof, the legends defining an area for inserting non-permanent markings using said marking device, wherein said marking device utilizes a water soluble ink which is only and readily removable from said sign material by wiping with a liquid dampened wiper.

2. The system of claim 1 wherein said water soluble ink includes 0.5 percent by volume of alcohol.

3. The system of claim 2 wherein said marking device comprises a felt tip marker.

4. The system of claim 1 wherein said sign material is formed in a pre-determined shape having an integral tab for supporting said sign material in a display.

5. The system of claim 4 wherein said tab is bent parallel to a plane of said material.

6. The system of claim 1 wherein said liquid is water.

7. The system of claim 1 wherein said plastic is between 0.015 and 0.030 inches in thickness.

8. The system of claim 1 wherein said plastic has a calendered surface.

9. The system of claim 8 wherein said permanent legends are printed on said calendered surface.

10. The system of claim 1 wherein said legends are screen printed.

11. The system of claim 1 wherein said legends include a border defining said area for non-permanent marking.

12. The system of claim 1 wherein said legends define a plurality of areas for inserting non-permanent markings.

13. A reusable marking system comprising:

support means;

a marking surface formed of a high impact styrene plastic, said marking surface being attached to said support means, and a marking device for marking on said surface, said marking device utilizing a water base ink which can only and readily be removed from said surface by wiping with a damp wiper.

14. The system of claim 13 wherein the water base ink is compounded of a solution of a water base dye and alcohol.

15. The system of claim 14 wherein said alcohol comprises methyl alcohol.

16. The system of claim 14 wherein said alcohol comprises 0.5 percent by volume of said water base ink.

17. The system of claim 13 wherein said marking surface is calendered.

18. The system of claim 13 wherein said marking surface has a matte finish.

19. The system of claim 13 wherein said marking surface is formed of a plastic sheet having a thickness of approximately 0.015 inches.

20. The system of claim 13 wherein said marking surface includes a screen-printed border.

* * * * *